US006155271A

United States Patent [19]

Sussman

[11] Patent Number: 6,155,271

[45] Date of Patent: Dec. 5, 2000

[54] FINGERNAIL-POLISHING METHOD FOR HOME USE

[76] Inventor: Robert Sussman, 10120 Vestal Ct., Coral Springs, Fla. 33071

[21] Appl. No.: 09/174,633

[22] Filed: Oct. 19, 1998

Related U.S. Application Data

[63] Continuation of application No. 09/002,746, Jan. 5, 1998.

[51] Int. Cl.[7] ..... A45D 24/00

[52] U.S. Cl. ..... 132/200; 132/73

[58] Field of Search ..... 132/200, 73, 73.5

[56] References Cited

U.S. PATENT DOCUMENTS

| | | | |
|---|---|---|---|
| 2,662,534 | 12/1953 | Swartz | 132/73 |
| 2,771,082 | 11/1956 | Sawyer | 132/73 |
| 4,296,766 | 10/1981 | Benis | 132/73 |
| 4,321,935 | 3/1982 | Sussman | 132/73 |

*Primary Examiner*—Jeffrey A. Smith
*Assistant Examiner*—Eduardo C. Robert
*Attorney, Agent, or Firm*—Myron Amer PC

[57] ABSTRACT

A movable support for positioning a left/right hand during the application of polish to a user's four fingernails in the use of which the user's thumb on an adjacent support surface steadies the four-finger support against movement from the polishing position.

1 Claim, 1 Drawing Sheet

PRIOR ART
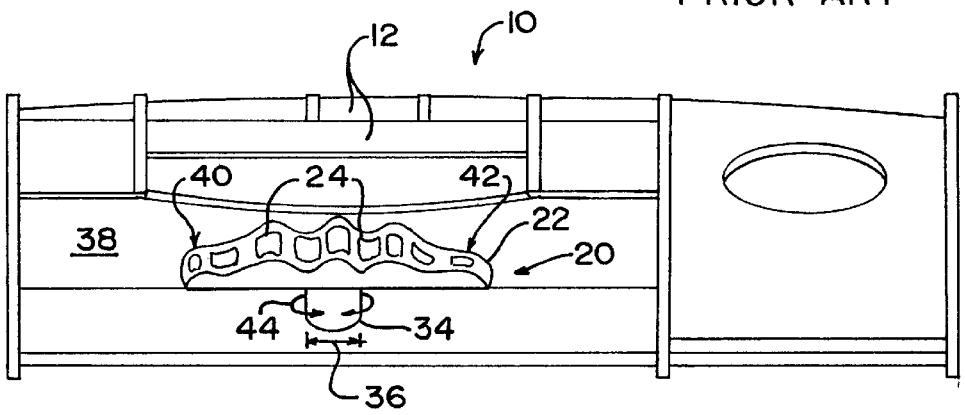
FIG. 1
FIG. 2
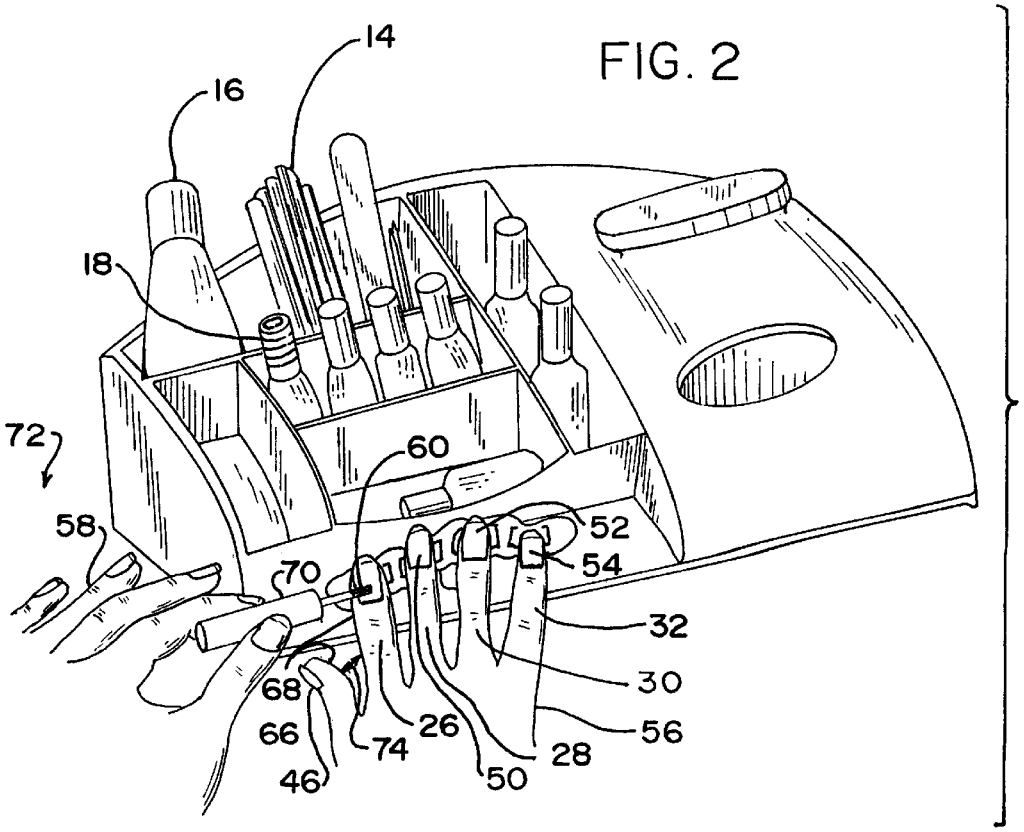

FINGERNAIL-POLISHING METHOD FOR HOME USE

This is a continuation of application Ser. No. 09/002,746, filed Jan. 5, 1998.

The present invention relates generally to improvements in fingernail polishing techniques, the improvements more particularly facilitating applying polish to fingernails without the assistance of a manicurist or another individual, thus contributing to an at-home or non-salon practice of the within inventive technique.

BACKGROUND OF THE INVENTION

Field of the Invention

Convenience articles of manufacture for the treatment of fingernails are already known, as exemplified by the patents issued to Howard Sussman for "Manicure Bowl" of U.S. Pat. No. Des. 278,367 on Apr. 9, 1985 and "Fingernail-Polishing Article of Manufacture" of U.S. Pat. No. 4,321,935 on Mar. 30, 1982. The design '367 convenience article is noted because it can be used either in a salon or at home, but only for fingernail preparation for polishing, and not for polishing per se. The '935 article however is used for polishing per se and, to this end, has a universally movable support for the fingers of the user which in practice has been found difficult to use without assistance as instructed in the '935 patent, because the movable support is held in an appropriate position of movement by the fingers supported thereon, and this entails balancing the support relative to its depending spherical ball which provides the universal degrees of movement.

SUMMARY OF THE INVENTION

Broadly, it is an object of the present invention to provide an unassisted at-home fingernail-polishing method overcoming the foregoing and other shortcomings of the prior art.

More particularly, it is an object to allow rotative movement in a finger support for general positioning, and subsequent restricted degrees of movement to facilitate applying nail polish in which the fingernails presented for polishing are held in place by the user's thumb, all as will be better understood as the description proceeds.

BRIEF DESCRIPTION OF THE DRAWING

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a plan view of a fingernail-positioning device for facilitating the fingernail polishing method of the present invention; and FIG. 2 is a perspective view illustrating the practice of the within inventive-fingernail polishing method using the device of FIG. 1.

DESCRIPTION OF THE PREFERRED EMBODIMENT

FIG. 1 illustrates a plastic article of manufacture, generally designated 10, of a known type as exemplified by the device of U.S. Pat. No. 4,321,935 for "Fingernail-Polishing Article of Manufacture" issued to Howard Sussman on Mar. 30, 1982 to mention but one of many prior patented devices, having the utility of providing compartments, individually and collectively designated 12, for storing, preparatory to use, cosmetic implements such as brushes 14, hand lotion 16 and more pertinent to the practice of the within method bottled nail polish 18.

Device 10 includes in an accessible location forward of the storage components 12, a fingernail-positioning member, generally designated 20, having a support 22 with indentations, individually and collectively designated 24, in the use of which device, the four fingers 26, 28, 30 and 32 are respectively seated, as shown in FIG. 2. The fingernail-positioning member 20 has a cylindrical depending leg 34 of a selected diameter 36 which it will be understood is suspended through a slightly oversized opening (not shown) in a horizontally oriented wall 38 so that in the clearance between the slightly undersized leg 34 and slightly oversized opening in wall 38, support 22 has a left tilting 40, a right tilting 42, and opposite circular degree of movement 44 which degrees of movement 40, 42 and 44, are used in positioning a user's fingernail 46 on the finger 26 adjacent the thumb 48, commonly known as the pointing finger, the fingernail 50 on the next right adjacent finger 28, the fingernail 52 on the next right adjacent finger 30, and finally the fingernail 54 of the user's pinkie 32.

Device 10 as typically used in a salon by a manicurist contemplates the user assuming an appropriate fingernail preparation position as shown in FIG. 2, and being held in that position by one hand of the manicurist who applies polish to the fingernails with the other hand. In home use of device 10, however, without assistance of another individual, the maintaining of the FIG. 2 fingernail preparation position requires a difficult balancing of the support 20 to minimize inadvertent movements 40, 42 or 44, in the hand 56 being attended to, while the other hand 58 applies the nail polish 60 of a selected nail polish bottle 18.

In accordance with the present invention, the nail-polishing procedure is significantly enhanced by the user's thumb 48 resting on a stationary flat surface 64 of a table or the like, which thumb position, as at 66, has the stabilizing effect, similar to the holding of the user's hand by a salon manicurist, of obviating inadvertent movements 40, 42 and/or 44 in the finger-supporting support. Additionally, and most significant, there is a gap 68 between the thumb 48 and adjacent finger 26 and during the application of the nail polish should any adjustment in the position of the fingernails 46, 50, 52 and 54 in relation to the polish being applied by brush 70 by the free hand 58 of the user 72, be required, the appropriate position adjustment is readily achieved by opening and/or closing movements 74 in the gap 68.

From the foregoing it should be readily appreciated that with a change in position of the hands 56 and 58 that the within inventive method is used to advantage to apply fingernail polish 60 to the fingernails of the left hand 58.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A fingernail-polishing method for home use and without assistance, said method comprising the steps of:

1) establishing a fingernail-polishing site in direct facing relation to a user;

2) positioning a left hand thumb on a support adjacent said fingernail-polishing site;

3) positioning a left hand pinky, ring finger, middle finger and pointing finger on a movable support adjacent said fingernail-polishing site;

4) urging said pinky in movement to said fingernail-polishing site from said position thereof adjacent thereto by maintaining stationary said support-positioned thumb and closing a gap between said thumb and pointing finger to a selected width;

5) polishing a fingernail of said pinky;

6) urging said ring finger in movement to said fingernail-polishing site from said position thereof adjacent thereto by maintaining stationary said support-positioned thumb and opening a gap between said thumb and pointing finger to a width slightly exceeding said selected width;

7) polishing a fingernail of said ring finger;

8) repeating the aforesaid steps 4–7 for said middle finger and said pointing finger; and 9) maintaining the positioning of said polished fingernails of said pinky, ring finger, middle finger and pointing finger on said support until the drying of said polish thereon.

* * * * *